US005657548A

United States Patent [19]

Kellar, Sr.

[11] Patent Number: 5,657,548

[45] Date of Patent: Aug. 19, 1997

[54] SUPPORT FOR MEASURING CORD

[76] Inventor: Fredrick B. Kellar, Sr., 918 Greenwood St., Washington, Ind. 47501

[21] Appl. No.: 597,942

[22] Filed: Feb. 7, 1996

[51] Int. Cl.[6] ..... E04G 21/18

[52] U.S. Cl. ..... 33/405; 33/413; 33/1 H

[58] Field of Search ..... 33/16, 1 H, 339, 33/405, 406, 413

[56] References Cited

U.S. PATENT DOCUMENTS

| | | | |
|---|---|---|---|
| Re. 24,044 | 7/1955 | Breuninger | 33/405 |
| 1,130,926 | 3/1915 | Peck | 33/1 H |
| 1,320,352 | 10/1919 | Werner | 33/1 H |
| 1,609,912 | 12/1926 | Mazeau | 33/1 H |
| 2,934,826 | 5/1960 | Klaum . | |
| 3,381,379 | 5/1968 | Fergen | 33/1 LE |
| 3,823,480 | 7/1974 | Grundman . | |
| 3,861,046 | 1/1975 | Arn | 33/405 |
| 4,080,739 | 3/1978 | Ruhaak | 33/405 |
| 4,095,343 | 6/1978 | McPhail . | |
| 4,924,579 | 5/1990 | Berendsen . | |
| 4,932,134 | 6/1990 | Meadows | 33/1 H |
| 5,119,565 | 6/1992 | Horvath et al. | 33/405 |

FOREIGN PATENT DOCUMENTS

| | | | |
|---|---|---|---|
| 389258 | 7/1965 | Switzerland | 33/1 LE |
| 700207 | 11/1953 | United Kingdom | 33/413 |
| 715062 | 8/1954 | United Kingdom | 33/413 |

*Primary Examiner*—Thomas B. Will

*Attorney, Agent, or Firm*—Frijouf, Rust & Pyle, P.A.

[57] ABSTRACT

A support is disclosed for adjustably supporting a distal end of a measuring cord relative to a ground surface. The support includes a body member having a longitudinally extending slot. A first and a second pin is slidably disposed within the first and second apertures in the body member with the first and second pins being able to be driven into the ground surface to vertically position the body member relative to the ground surface. A hook is slidably mounted within the slot for supporting the distal end of the measuring cord and for horizontally positioning the distal end of the measuring cord relative to the ground surface.

8 Claims, 4 Drawing Sheets

SUPPORT FOR MEASURING CORD

BACKGROUND OF THE INVENTION

1. Field Of The Invention

This invention relates to measuring through the use of a measuring cord and more particularly to an improved support for adjustably supporting the distal end of the measuring cord relative to a ground surface.

2. Background Of The Invention

Various types of measuring and marking devices have been used in the prior art in the construction of building structures and the like. One of the most common and efficient means of marking areas for foundations and the like is through the use of a stretched line or measuring cord for indicating the position and direction and height of a foundation or the like.

The prior art has used stretched line or measuring cord for marking the position of the construction of foundation footers and the like. Typically, the measuring cords were supported by batter boards constructed of wood or the like. For a structure having a rectangular foundation, a pair of two batter boards were constructed proximate each of the four comers of the foundation of the structure. For a more complex foundation, additional batter boards were required on each of the comers of the building structure.

After the batter boards were properly positioned, a distal end of the measuring cord was affixed to the batter boards through the use of metallic hooks affixed to the batter boards for supporting the distal end of the measuring cord to mark the position of the foundation. A trench was dug in accordance with the measuring cord such that the trench was accurately positioned for supporting the walls of the building structure. After the trenches were dug, the measuring cords were removed and a combination of concrete and/or steel reinforcement rods was placed within the trench to form the foundation for the building structure. In some cases, it was desirable for the measuring cord to be leveled four assisting in the leveling of the concrete within the foundation trench. In such an event, an operator was required to remove the measuring cord from the metallic hooks and to adjust the height of the metallic hooks to level the measuring cord.

Although the prior art has used wooden batter boards for many years, the use of wooden batter boards has certain disadvantages. Firstly, the wood of the batter boards deteriorates in hostile environments and has a tendency to warp thereby moving the positions of the measuring cord making the positions correspondingly less accurate. A second disadvantage of the use of wooden batter boards is the difficulty in changing the position of the metallic hooks for altering the position of the distal end of the measuring cord. A further disadvantage of the use of wooden batter boards is the high cost of the wood which is generally scraped at the end of the construction project.

Some in the prior art have realized the inadequacy of wooden batter boards and have proposed the use of various devices for eliminating the use of wooden batter boards.

U.S. Pat. No. 2,934,826 to Klaum discloses a collapsible batter board unit for use in building construction, said unit comprising a pair of batter boards hinged together for swinging movement from a collapsed position in which the boards lie in contiguous relation throughout their length to an extended position in which the boards define substantially a right angle, each board being constituted by an elongated structural member of generally L-shaped configuration in transverse section and supported, when in use, with one side of the L extending generally horizontally and with the other side depending therefrom, a corner leg hinged to the depending side of one of said boards adjacent the intersection of said boards, and end legs hinged to the depending side of each of said boards at a point remote from the intersection of said boards, each leg being hinged for swinging movement from a collapsed position in which it lies partly within the board and in contiguous relation with the board throughout its length to an extended position perpendicular to the board with its upper end lying immediately beneath and in abutting relation with the horizontal side of the board to which it is hinged, whereby the free ends of the legs may be driven into the ground by striking the boards at points directly above the legs without damage to the hinged connection therebetween, each leg being constituted by an elongated structural member of generally L-shaped configuration in transverse section, and pivot pins extending through each leg and the depending side of the associated board, and through the horizontal sides of the boards, to effect the hinged connections therebetween.

U.S. Pat. No. 3,381,379 to Fergen discloses a plurality of folding batter boards pivotally secured at their adjacent ends and releasably held at their other ends in an original building layout for movement in a common plane to allow passage of equipment, while accurately preserving the original building layout and grade.

U.S. Pat. No. 3,823,480 to Grundman discloses a pair of rectangular frames formed from circular cross-sectional material and pivotally interconnected at one end with the opposite ends being held in spaced apart 90° relationship by a brace member. The top frame portion of each frame includes a rotatable and slidable line holder having a hand-adjustable setscrew. A pair of stakes are secured to the bottom frame portions of each frame by flexible chains and include flanges for engaging the bottom frame portions when the stakes are driven into the ground for holding the batter boards in place.

U.S. Pat. No. 4,080,739 to Ruhaak discloses a batter board for use in building construction having, in one embodiment, two vertical support members and two horizontal alignment members which together maintain a constant spacing between the support members. One of the alignment members is affixed to the support members at the upper ends thereof, while the second alignment member is movably affixed to the support members in such a manner that it may be selectively positioned along the vertical axes of the support members. A slide member is movably affixed to the second alignment member whereby the slide member may be selectively positioned substantially anywhere within the plane defined by the ends of the support members. The basic structure just described may be advantageously modified by the addition of other support and alignment members.

U.S. Pat. No. 4,095,343 to McPhail discloses each of four templates comprising crossed strips which define straight edges for aligning masons lines. Additional strips are fixed to, and extend perpendicularly from, one end of each of the cross strips. Notches in these additional strips define pin locations for wall and footing lines.

U.S. Pat. No. 4,924,579 to Berendsen discloses a method and apparatus for laying out foundations prior to construction. Ideally, two stakes are provided for each corner to be formed in a construction project and line extends from each corner to an adjacent corner. Each stake is configured with a clamping mechanism which allows vertical and horizontal adjustment of the string associated therewith.

U.S. Pat. No. 4,932,134 to Meadows discloses an adjustable foundation locating device used to position or locate forms and trenches needed for pouring concrete foundations. The device uses a horizontal member which is supported by a stake driven into the ground. The horizontal member may be moved up or down the stake until it is located at a desirable height and then secured in place by tightening a bolt threaded into a bracket attached to the horizontal member. Sleeve members may be slid back and forth along the longitudinal length of the horizontal member until they are properly located and then secured in place by tightening bolts threaded into the sleeve members. Strings may then be tied to the sleeve members and pulled taut between two devices located at opposite ends of a trench needed for a concrete foundation. The strings may then be used as guides to position or locate the trench or a concrete form needed for pouting the concrete foundation. A stabilizing member may be used to help secure the horizontal member to the stake. The device may be secured across the top of two concrete forms by using the bracket on the device to clamp it to a flange at the top of one of the forms. Adjustable support members may be used with stakes to position one of the horizontal members which slidably engages the support members. The horizontal member may be secured to the support members by bolts which are threaded into sleeve members of the support members.

Although these non-metallic batter boards of the prior art had contributed to the advancement of the construction art, the aforementioned metallic batter are overly complex, expensive and do not allow for the vertical and/or horizontal adjustment of the distal end of the measuring cord in a simple and efficient manner.

Therefore, it is an object of the present invention to provide an improved support for adjustably supporting a measuring cord which enables an operator to adjust the vertical and horizontal position of the distal end of the measuring cord in a simple and efficient manner.

Another object of this invention is to provide an improved support for adjustably supporting a distal end of a measuring cord which is made out of a non-corrosive metallic material for maintaining an accurate position of the distal end of the measuring cord in inclement weather.

Another object of this invention is to provide an improved support for adjustably supporting a distal end of a measuring cord wherein the vertical and horizontal adjustments the distal end of the measuring cord can be made in accordance with graduated scales.

Another object of this invention is to provide an improved support for adjustably supporting a distal end of a measuring cord which is lightweight, low cost and can be installed on a construction area more rapidly than the devices of the prior art.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a support for adjustably supporting a measuring cord relative to a ground surface comprising a body member extending between a first and a second end. A longitudinally extending slot is defined in the body member. A hook is slidably mounted within the longitudinally extending slot of the body member for supporting the measuring cord. A first and second aperture is disposed proximate the first and second ends of the body member. A first and a second pin is slidably disposed within the first and second apertures. The first and second pins are able to be driven into the ground surface. A first and second pin locking means secure the first and second pins within the first and second apertures to position the body member above and parallel to the ground surface. A hook locking means locks the position of the hook within the longitudinally extending slot for horizontally positioning the distal end of the measuring cord.

In a more specific embodiment of the invention, the body member comprises a first and a second leg extending generally perpendicular to one another. The longitudinally extending slot is defined in the first leg of the body member. The hook has a threaded portion extending through the longitudinally extending slot of the body member. The hook locking means comprises a hook threaded fastener for locking the position of the hook within the longitudinally extending slot. An optional scale may be disposed on the second leg of the body member for indicating the position of the hook within the longitudinally extending slot.

In one embodiment of the invention, a first and a second cylindrical tube is secured to the first and second legs in proximity to the first and second ends of the body member. Each of the first and second cylindrical tubes defines the first and second apertures disposed proximate the first and second ends of the body member. Each of the first and second pins includes a pointed end and a blunt end for enabling the pointed end to be driven into the ground upon striking the blunt end. Each of the first and second pin locking means includes a pin threaded fastener for securing the first and second pins within the first and second apertures. Each of the first and second pins includes a plurality of space graduations for indicating the position of the body member relative to each of the first and second pins to vertically position the distal end of the measuring cord above the ground surface.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
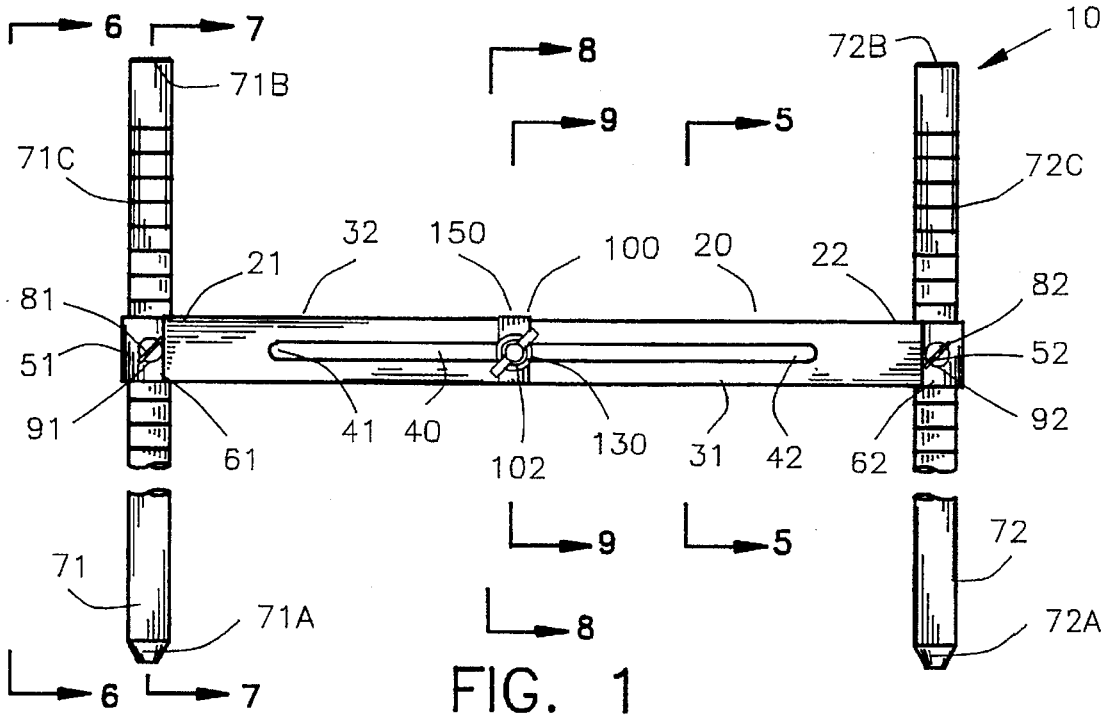
FIG. 1 is a front view of the support of the present invention.
Figure 2:
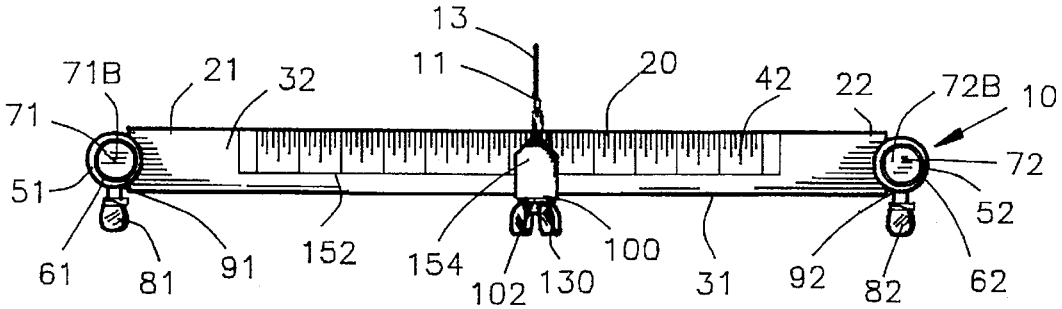
FIG. 2 is a top view of FIG. 1.
Figure 3:
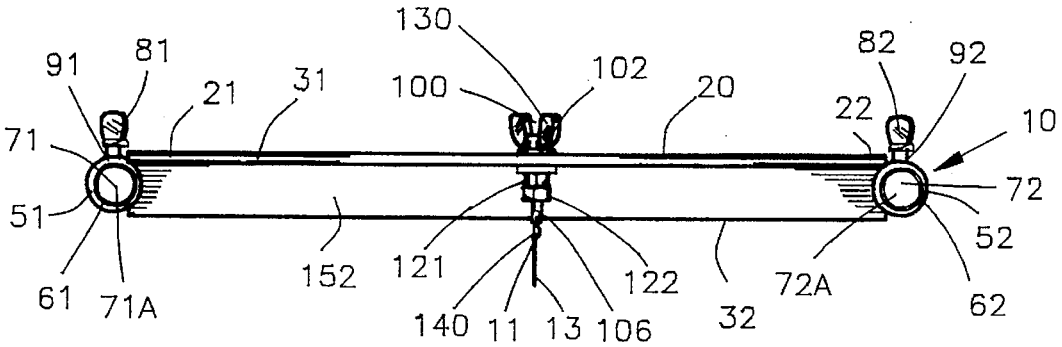
FIG. 3 is a bottom view of FIG. 1.
Figure 4:
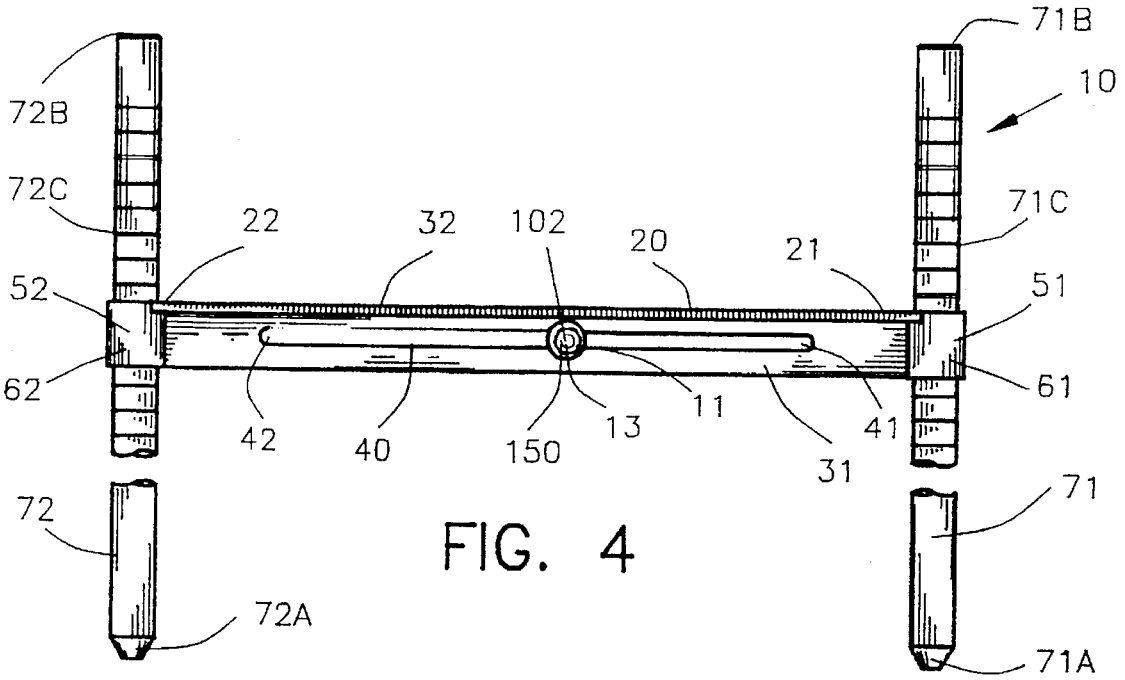
FIG. 4 is a rear view of FIG. 1.

FIG. 1 is a front view of the support 10 for adjustably supporting a distal end 11 of a measuring cord 13 relative to a ground surface 14. FIGS. 2–4 are top, bottom and rear views of FIG. 1. The support 10 comprises body member 20 extending between a first end 21 and a second end 22.

Figure 5:
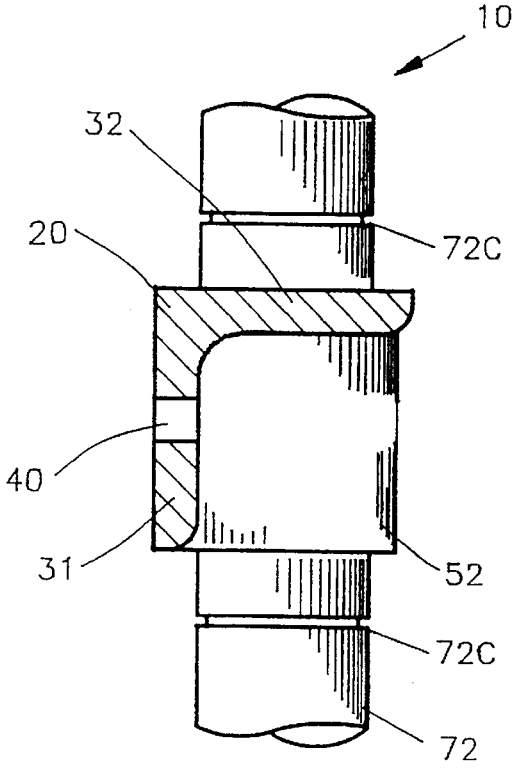
FIG. 5 is an enlarged sectional view along line 5—5 of FIG. 1.

FIG. 5 is an enlarged sectional view along line 5—5 of FIG. 1. The body member 20 comprises a first leg 31 extending generally perpendicular to a second leg 32. Preferably, the first leg 31 is integrally formed with the second leg 32 from a metallic material such as aluminum, steel or the like. In the alternative, the body member 20 may be formed from a polymeric material. A longitudinally extending slot 40 is defined in the body member 20 with the slot extending through the first leg 31 of the body member 20 between a first and a second slot end 41 and 42.

Figure 6:
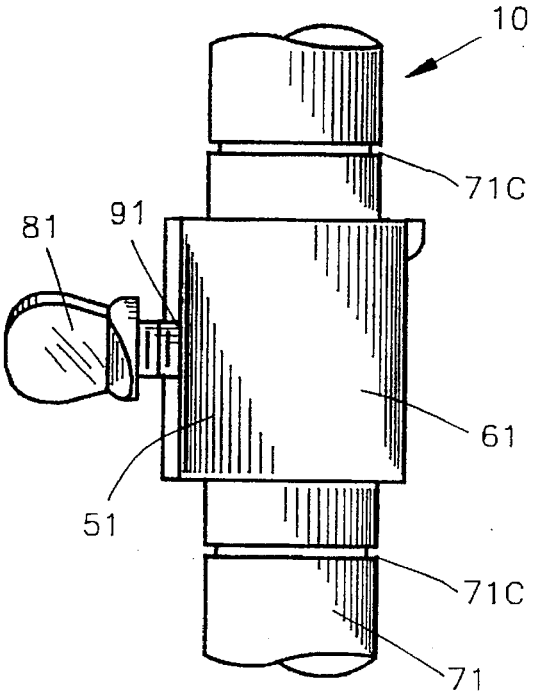
FIG. 6 is an enlarged left side view of FIG. 1.
Figure 7:
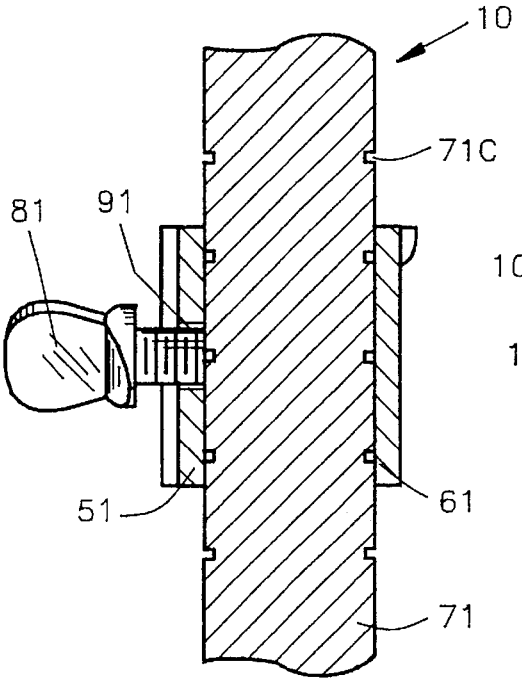
FIG. 7 is an enlarged sectional view along line 7—7 of FIG. 1.

FIG. 6 is an enlarged left side view of FIG. 1 whereas FIG. 7 is an enlarged sectional view along line 7—7 of FIG. 1. A first and a second cylindrical tube 51 and 52 are secured to the first and second legs 31 and 32 at the first and second ends 21 and 22 of the body member 20. The first and second cylindrical tubes 51 and 52 define a first and a second aperture 61 and 62 within the cylindrical interior of the first and second cylindrical tubes 51 and 52. Preferably, the first and second cylindrical tubes 51 and 52 are formed from a metallic material such as aluminum, steel or the like and are secured to the body member 20 by welding or any other suitable means. In the alternative, the first and second cylindrical tubes 51 and 52 may be formed integrally with the body member 20 from a polymeric material.

A first and a second pin 71 and 72 are slidably disposed within the first and second apertures 61 and 62 of the first and second cylindrical tubes 51 and 52. Each of the first and second pin 71 and 72 includes a pointed end 71A and 72A and a blunt end 71B and 72B for enabling the pointed ends 71A and 72A to be driven into the ground surface upon striking the blunt ends 71B and 72B with a hammer or the like.

Preferably, each of the first and second pins 71 and 72 includes vertical indicator means shown as a plurality of space graduations 71C and 72C for indicating the position of the first and second pins 71 and 72 within the first and second apertures 61 and 62. During the operation of the present invention, the plurality of space graduations 71C and 72C on the first and second pins 71 and 72 indicate the vertical position of the body member 20 relative to the ground surface. Preferably, the first and second pins 71 and 72 are formed from a metallic material such as aluminum, steel or the like or in the alternative, the first and second pins 71 and 72 may be formed from a polymeric material.

A first and a second pin locking means 81 and 82 secure the first and second pins 71 and 72 within the first and second apertures 61 and 62. The first and second pin locking means 81 and 82 are shown as thumb screws in threaded engagement with a first and a second threaded orifice 91 and 92 defined within the first and second cylindrical tubes 51 and 52. The first and second pin locking means 81 and 82 extend into the first and second apertures 61 and 62 for securing the first and second pins 71 and 72 within the first and second apertures 61 and 62.

Figure 8:
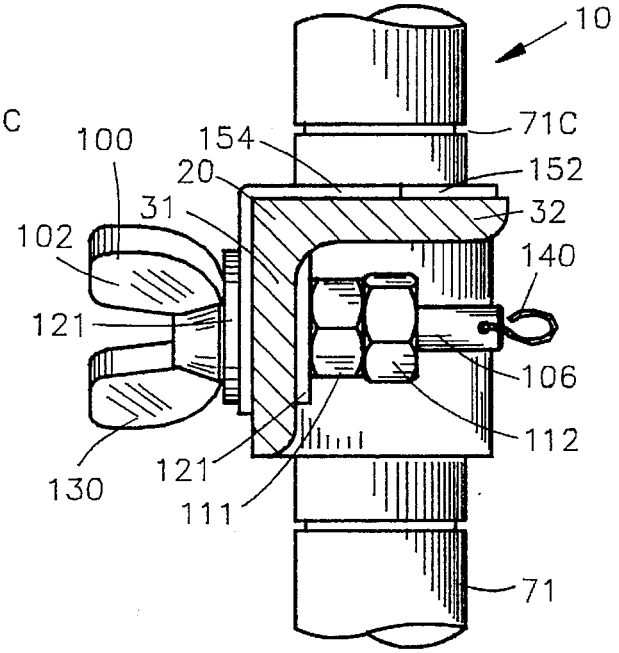
FIG. 8 is an enlarged sectional view along line 8—8 of FIG. 1.
Figure 9:
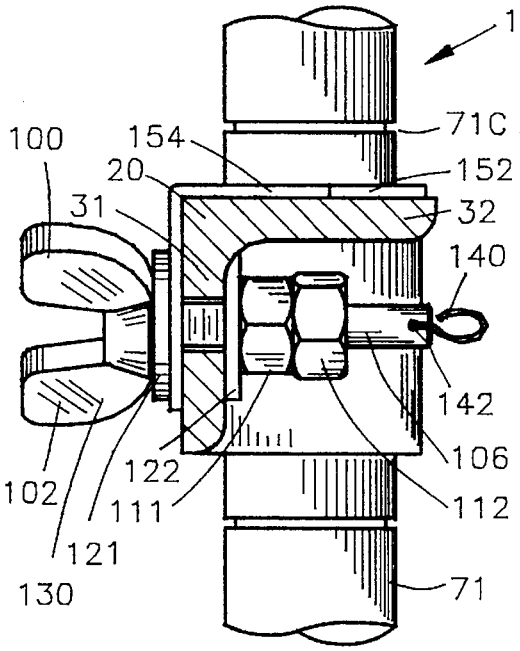
FIG. 9 is an enlarged sectional view along line 9—9 of FIG. 1.
Figure 10:
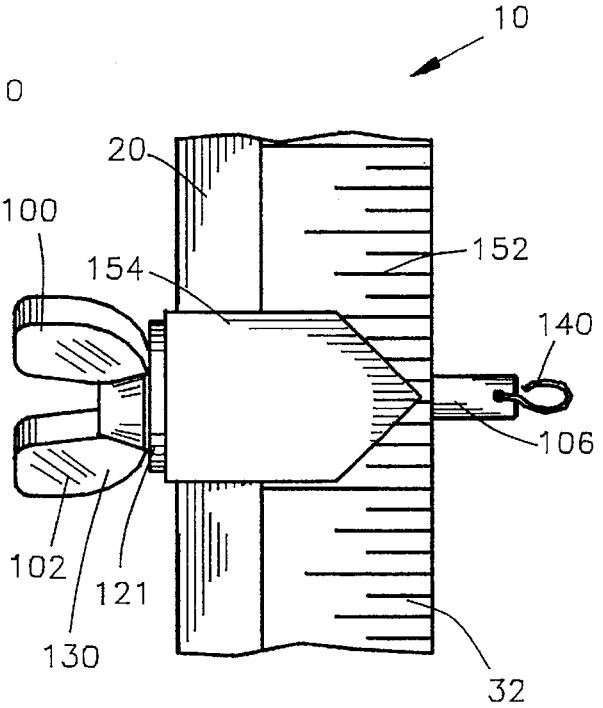
FIG. 10 is a top view of FIG. 9.

FIG. 8 is an enlarged sectional view along line 8—8 of FIG. 1 whereas FIG. 9 is an enlarged sectional view along line 9—9 of FIG. 1 with FIG. 10 being a top view of FIG. 9. A hook assembly 100 is slidably mounted within the longitudinally extending slot 40 of the body member 20 for movement between the first and second slot ends 41 and 42. The hook assembly 100 comprises a slidable member 102 having threaded shaft 106. The wingnut 130 functions as a handle for sliding the hook assembly 100 between the first and second slot ends 41 and 42 of the longitudinally extending slot 40 of the body member 20.

The threaded shaft 106 of the slidable member 102 extends through the longitudinally extending slot 40 of the body member 20. A first and a second nut 111 and 112 are prevented from movement or rotation on the threaded shaft 106 by jamming the first nut 111 relative to the second nut 112. A first washer 121 is interposed between the second nut 112 and the first leg 31 of the body member 20.

A hook locking means shown as a wingnut 130 and a second washer 122 is interposed between the wingnut 130 and the first leg 31 of the body member 20. The wingnut is threadably mounted on the threaded shaft 106 for locking the position of the hook assembly 100 within the longitudinally extending slot 40. The wingnut 130 functions as a handle for sliding the hook assembly 100 between the first and second slot ends 41 and 42 of the longitudinally extending slot 40 of the body member 20.

The hook assembly 100 includes a measuring cord hook 140 for supporting the distal end 11 of the measuring cord 13. The measuring cord hook 140 extends through a through hole 142 within the threaded shaft 106. The measuring cord hook 140 provides a means for securing the distal end 11 of the measuring cord 13 to the hook assembly 100 for horizontally positioning the distal end 11 of the measuring cord 13 relative to the ground surface.

A horizontal indicator means 150 indicates the position of the hook assembly 100 within said longitudinally extending slot 40 of the body member 20. The horizontal indicator means 150 includes a scale 152 disposed on the second leg 32 of the body member 20. A pointer 154 is secured to the threaded shaft 106 for indicating on the scale 152 of the position of the hook assembly 100 within the longitudinally extending slot 40.

Figure 11:
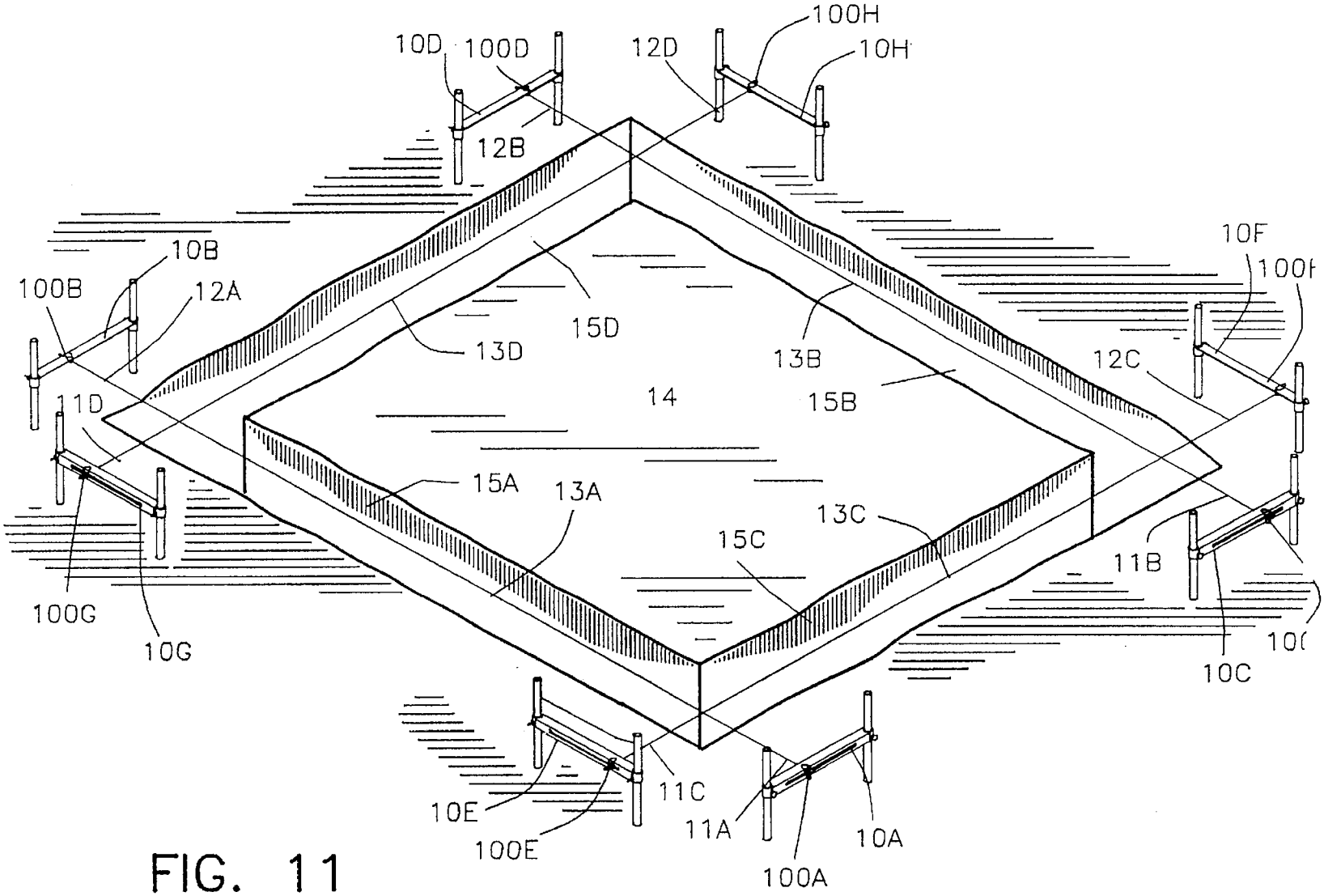
FIG. 11 is an isometric view of a construction area illustrating the use of a plurality of the supports of the present invention.

FIG. 11 is an isometric view of a construction area defined by the ground surface 14. The construction area requires a rectangular foundation trench 15 shown as foundation trenches 15A–15D, respectively. First, the supports 10A–10H are positioned in proximity to the desired position of the foundation trenches 15A–15D. After the supports 10A–10H are positioned in proximity to the desired position of the foundation trenches 15A–15D, the plurality of measuring cords 13A–13D are affixed to the supports 10A–10H. The plurality of measuring cords 13A–13D mark the approximate position of the foundation trenches 15A–15D, respectively.

The supports 10A and 10B position the distal ends 11A and 12A of the measuring cord 13A; the supports 10C and 10D position the distal ends 11B and 12B of the measuring cord 13B; the supports 10E and 10F position the distal ends 11C and 12C of the measuring cord 13C; and the supports 10G and 10H position the distal ends 11D and 12D of the measuring cord 13D.

The supports 10A and 10B horizontally and vertically position the distal ends 11A and 12A of the measuring cord 13A relative to the ground surface 14. An adjustment of one of the hook assemblies 100A and/or 100B adjusts the horizontal position the distal ends 11A and/or 12A of the measuring cord 13A. The adjustment of the hook assemblies 100A and/or 100B may be made in accordance with the horizontal indicator means 150A and/or 150B. After adjustment of the hook assemblies 100A–100H of the supports 10A–10H, the plurality of measuring cords 13A–13D mark the exact horizontal position of the foundation trenches 15A–15D, respectively.

The foundation trenches 15A–15D can be excavated in accordance with the measuring cords 13A–13D such that the foundation trenches 15A–15D are accurately positioned for the intended positions of the walls of the building structure. After excavation of the foundation trenches 15A–15D, the measuring cords 13A–13D may be removed and a combination of concrete and/or steel reinforcement rods may be placed within the foundation trenches 15A–15D to form the foundation for the building structure.

After the combination of concrete and/or steel reinforcement rods are placed within the foundation trenches 15A–15D, the measuring cords 13A–13D are replaced upon the supports 10A–10H. The measuring cords 13A–13D may be vertically adjusted for indicating the desired level of the concrete within the foundation trenches 15A–15D. Accordingly, the concrete within the foundation trenches 15A–15D may be troweled to a smooth surface having a desired level indicated by the measuring cords 13A–13D. For example, the measuring cords 13A–13D may be adjusted to be a specified distance above the desired level of the concrete within the foundation trenches 15A–15D. The plurality of space graduations 71C and 72C on the first and second pins 71 and 72 assist in the vertical positioning of the measuring cords 13A–13D relative to the ground surface 14.

After the concrete within the foundation trenches 15A–15D is cured, the measuring cords 13A–13D may be adjusted to be another specified distance above the desired level of the concrete within the foundation trenches 15A–15D to mark the desired position of a first course of bricks or blocks (not shown). The plurality of space graduations 71C and 72C on the first and second pins 71 and 72 assist in the vertical repositioning of the measuring cords 13A–13D relative to the ground surface 14. Thereafter, the measuring cords 13A–13D may be readjusted to mark the desired position of a second course of bricks or blocks (not shown). After the measuring cords 13A–13D are no longer needed at the construction area, the measuring cords 13A–13D and the supports 10A–10H are removed and the supports 10A–10H may be stored for reuse at a later time.

The present invention provides an improved support 10 for adjustably supporting a measuring cord 13 which enables an operator to adjust the vertical and horizontal position of a distal end 11 of the measuring cord 13 in a simple and efficient manner. The improved support 10 is lightweight, low cost and can be installed on a construction area more rapidly than the devices of the prior art. The improved support 10 enables the vertical and horizontal adjustments of the measuring cord 13 to be made in accordance with graduated scales. The improved support 10 is constructed of a non-corrosive metallic material for maintaining an accurate position of the distal end of the measuring cord 13 during inclement weather.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A support for adjustably supporting a measuring cord relative to a ground surface comprising:

a body member extending between a first and a second end;

said body member being a general L- shape comprising a first and a second leg extending generally perpendicular to one another;

said first leg of said body member having a longitudinal axis extending between a first and a second end and having a transverse axis extending normal to said longitudinal axis;

a longitudinally extending slot defined in said body member;

said longitudinally extending slot extend through said first leg of said body member and along the majority of said body member;

a hook having a threaded portion extending through and slidably mounted within said longitudinally extending slot of said body member for supporting the measuring cord;

horizontal indicator means for indicating the position of said hook within said longitudinally extending slot;

a first and a second tube defining a first and a second aperture;

said first and second tubes being respectively connected to said first and second ends of said body member with said transverse axis of said first leg of said body member being parallel to an axis of each of said first and second apertures;

a first and a second pin slidably disposed within said first and second apertures;

each of said first and second pins including a pointed end and a blunt end for enabling said pointed end to be driven into the ground surface upon striking said blunt end for positioning said body member above and parallel to said ground surface;

first and second pin locking means for securing said first and second pins within said first and second apertures to position said body member above and parallel to said ground surface; and a hook locking means comprising a hook threaded fastener threadably cooperating with said threaded portion of said hook for locking the position of said hook within said longitudinally extending slot to horizontally position the distal end of the measuring cord relative to the ground surface.

2. A support for adjustably supporting a measuring cord as set forth in claim 1, wherein said horizontal indicator means includes a scale disposed on said second leg of said body member and a pointer secured to said hook for indicating the position of said hook within said longitudinally extending slot.

3. A support for adjustably supporting a measuring cord as set forth in claim 1, wherein said first and second tubes comprise first and second cylindrical tubes defining said first and second apertures disposed proximate said first and second ends of said body member.

4. A support for adjustably supporting a measuring cord as set forth in claim 1, wherein each of said first and second pin locking means includes a pin threaded fastener for securing said first and second pins within said first and second apertures.

5. A support for adjustably supporting a measuring cord as set forth in claim 1, wherein said first and second pin locking means includes a first and a second pin threaded fastener extending into said first and second apertures for securing said first and second pins within said first and second apertures.

6. A support for adjustably supporting a measuring cord as set forth in claim 1, including vertical indicator means for indicating the position of the body member relative to the ground surface.

7. A support for adjustably supporting a measuring cord as set forth in claim 1, including vertical indicator means comprising each of said first and second pins having a plurality of space graduations for indicating the position of the body member relative to each of said first and second pins to vertically position the distal end of the measuring cord above the ground surface.

8. A support for adjustably supporting a measuring cord relative to a ground surface comprising:

a body member extending between a first and a second end;

said body member being a general L- shape comprising a first and a second leg extending generally perpendicular to one another;

said first leg of said body member having a longitudinal axis extending between a first and a second end and having a transverse axis extending normal to said longitudinal axis;

a longitudinally extending slot defined in said body member;

said longitudinally extending slot extend through said first leg of said body member and along the majority of said body member;

a hook having a threaded portion extending through and slidably mounted within said longitudinally extending slot of said body member for supporting the measuring cord;

horizontal indicator means for indicating the position of said hook within said longitudinally extending slot;

a first and a second cylindrical tube secured to said first and second legs in proximity to said first and second ends of said body member;

each of said first and second cylindrical tubes defining said first and second apertures disposed proximate said first and second ends of said body member with said transverse axis of said first leg of said body member being parallel to an axis of each of said first and second apertures;

a first and a second pin slidably disposed within said first and second apertures;

each of said first and second pins including a pointed end and a blunt end for enabling said pointed end to be driven into the ground surface upon striking said blunt end for positioning said body member above and parallel to said ground surface;

first and second pin locking means for securing said first and second pins within said first and second apertures to vertically position said body member above and parallel to said ground surface;

said first and second pin looking means includes a first and a second pin threaded fastener threadably extending through each of said first and second cylindrical tubes and into said first and second apertures for securing said first and second pins within said first and second apertures; and a hook locking means comprising a hook threaded fastener threadably cooperating with said threaded portion of said hook for locking the position of said hook within said longitudinally extending slot to horizontally position the distal end of the measuring cord relative to the ground surface when said cord is connected to said hook.

* * * * *